US007198163B2

(12) United States Patent
Young et al.

(10) Patent No.: US 7,198,163 B2
(45) **Date of Patent: *Apr. 3, 2007**

(54) PLASTIC BLOW MOLDED FREESTANDING CONTAINER

(75) Inventors: William C. Young, Superior Township, MI (US); Richard C. Darr, Seville, OH (US); Dale M. Behm, Palm Springs, CA (US)

(73) Assignee: Plastipak Packaging, Inc., Plymouth, MI (US)

( * ) Notice: Subject to any disclaimer, the term of this patent is extended or adjusted under 35 U.S.C. 154(b) by 53 days.

This patent is subject to a terminal disclaimer.

(21) Appl. No.: 11/123,322

(22) Filed: May 6, 2005

(65) Prior Publication Data

US 2005/0199578 A1 Sep. 15, 2005

Related U.S. Application Data

(63) Continuation of application No. 10/689,360, filed on Oct. 20, 2003, now Pat. No. 6,908,002, which is a continuation of application No. 09/886,644, filed on Jun. 21, 2001, now Pat. No. 6,659,299, which is a continuation of application No. 09/502,100, filed on Feb. 10, 2000, now Pat. No. 6,260,724, which is a continuation of application No. 09/210,318, filed on Dec. 11, 1998, now abandoned, which is a continuation of application No. 08/877,663, filed on Jun. 18, 1997, now Pat. No. 5,850,931, which is a continuation of application No. 08/631,034, filed on Apr. 18, 1996, now Pat. No. 5,685,446, which is a continuation of application No. 08/166,460, filed on Dec. 14, 1993, now abandoned, which is a continuation of application No. 07/915,072, filed on Dec. 22, 1994, now Pat. No. 5,287,978, which is a continuation-in-part of application No. 07/771,636, filed on Oct. 4, 1991, now Pat. No. 5,139,162, which is a continuation of application No. 07/614,220, filed on Nov. 15, 1990, now Pat. No. 5,064,080.

(51) Int. Cl.
*B65D 1/02* (2006.01)
*B65D 1/42* (2006.01)
*B65D 23/00* (2006.01)

(52) U.S. Cl. ..... 215/375; 215/373; 220/606; 220/609

(58) Field of Classification Search ..... 215/371–375; 220/606, 608, 609
See application file for complete search history.

(56) References Cited

U.S. PATENT DOCUMENTS 3,395,955 A 8/1968 Marsell et al.

(Continued)

FOREIGN PATENT DOCUMENTS

DE 29 20 122 A1 11/1980

(Continued)

*Primary Examiner*—Sue A. Weaver
(74) *Attorney, Agent, or Firm*—Brooks Kushman P.C.

(57) ABSTRACT

A plastic blow molded container (10) is disclosed as including a freestanding base structure (20) that is constructed with a plurality of alternating hollow legs (22) and curved ribs (34), and a hub (41) from which the legs and ribs extend radially with a construction that provides good stability against tipping as well as the capability of withstanding internal pressure. The legs (22) have lower flat feet (24) with an outer diameter $D_f$, and the hub (41) has a periphery connected to the feet and ribs with a height $H_p$ such that the ratio of the diameter $D_f$ over the height $H_p$ is in the range of about 25 to 90 to maintain strength without the hub engaging the supporting surface on which the feet rest. The construction disclosed of the legs (22), ribs (34) and hub (41, 41' and 41") enhances the capability of the base structure in providing good stability as well as the capability of withstanding internal pressure and stress cracking.

9 Claims, 3 Drawing Sheets

U.S. PATENT DOCUMENTS

| | | | |
|---|---|---|---|
| 3,598,270 | A | 8/1971 | Adomaitis et al. |
| 3,727,783 | A | 4/1973 | Carmichael |
| 3,759,410 | A | 9/1973 | Uhlig |
| 3,871,541 | A | 3/1975 | Adomaitis |
| 4,108,324 | A | 8/1978 | Krishnakumar et al. |
| 4,247,012 | A | 1/1981 | Alberghini |
| 4,249,667 | A | 2/1981 | Pocock et al. |
| 4,254,882 | A | 3/1981 | Yoshino |
| 4,267,144 | A | 5/1981 | Collette |
| 4,276,987 | A | 7/1981 | Michel |
| 4,294,366 | A | 10/1981 | Chang |
| 4,318,489 | A | 3/1982 | Snyder et al. |
| 4,335,821 | A | 6/1982 | Collette et al. |
| 4,368,825 | A | 1/1983 | Motill |
| 4,598,831 | A | 7/1986 | Nakamura et al. |
| 4,785,948 | A | 11/1988 | Strassheimer |
| 4,785,949 | A | 11/1988 | Krishnakumar et al. |
| 4,785,950 | A | 11/1988 | Miller et al. |
| 4,850,493 | A | 7/1989 | Howard, Jr. |
| 4,850,494 | A | 7/1989 | Howard, Jr. |
| 4,865,206 | A | 9/1989 | Behm et al. |
| 4,867,323 | A | 9/1989 | Powers |
| 4,889,752 | A | 12/1989 | Beck |
| 4,892,205 | A | 1/1990 | Powers et al. |
| 4,910,054 | A | 3/1990 | Collette et al. |
| 4,978,015 | A | 12/1990 | Walker |
| 5,024,340 | A | 6/1991 | Alberghini et al. |
| 5,064,080 | A | 11/1991 | Young et al. |
| 5,072,841 | A | 12/1991 | Okhai |
| 5,133,468 | A | 7/1992 | Brunson et al. |
| 5,139,162 | A | 8/1992 | Young et al. |
| 5,205,434 | A | 4/1993 | Brunson et al. |
| 5,261,543 | A | 11/1993 | Ugarelli |
| 5,287,978 | A | 2/1994 | Young et al. |
| 5,320,230 | A | 6/1994 | Hsiung |
| 5,615,790 | A | 4/1997 | Young et al. |
| 5,664,695 | A | 9/1997 | Young et al. |
| 5,685,446 | A | 11/1997 | Young et al. |
| 5,803,290 | A | 9/1998 | Bongiorno |
| 5,829,614 | A | 11/1998 | Collette et al. |
| 5,850,931 | A | 12/1998 | Young et al. |
| 6,019,236 | A | 2/2000 | Slat |
| 6,260,724 | B1 | 7/2001 | Young et al. |
| 6,659,299 | B2 | 12/2003 | Young et al. |

FOREIGN PATENT DOCUMENTS

| | | |
|---|---|---|
| EP | 219696 | 4/1987 |
| EP | 225155 | 6/1987 |
| EP | 385693 | 9/1990 |
| GB | 2189214 | 10/1987 |
| JP | 1 99949 | 4/1989 |
| JP | 3 275431 | 3/1991 |
| JP | 4 44943 | 2/1992 |
| JP | 5 65165 | 5/1993 |
| JP | 5 254529 | 5/1993 |
| WO | WO 86/05462 | 9/1986 |
| WO | WO 92/00880 | 1/1992 |

PLASTIC BLOW MOLDED FREESTANDING CONTAINER

CROSS-REFERENCE TO RELATED APPLICATIONS

This application is a continuation of pending prior application Ser. No. 10/689,360 which was filed on Oct. 20, 2003 by William C. Young, Richard C. Darr and Dale H. Behm now U.S. Pat. No. 6,908,002, under the title PLASTIC BLOW MOLDED FREESTANDING CONTAINER as a continuation of application Ser. No. 09/886,644 which issued on Dec. 9, 2003 as U.S. Pat. No. 6,659,299 and was filed on Jun. 21, 2001 by William C. Young, Richard C. Darr and Dale H. Behm under the title PLASTIC BLOW MOLDED FREESTANDING CONTAINER as a continuation of application Ser. No. 09/502,100 which issued on Jul. 17, 2001 as U.S. Pat. No. 6,260,724 and was filed on Feb. 10, 2000 by William C. Young and Richard C. Darr under the title PLASTIC BLOW MOLDED FREESTANDING CONTAINER as a continuation of application Ser. No. 09/210,318, now abandoned, which was filed on Dec. 11, 1998 by William C. Young and Richard C. Darr under the title PLASTIC BLOW MOLDED FREESTANDING CONTAINER as a continuation of application Ser. No. 08/877,663 which issued on Dec. 22, 1998 as U.S. Pat. No. 5,850,931 and was filed on Jun. 18, 1997 by William C. Young, Richard C. Darr and Dale H. Behm under the title Plastic Blow Molded Freestanding Container as a continuation of prior application Ser. No. 08/631,034 which issued on Nov. 11, 1997 as U.S. Pat. No. 5,685,446 and was filed on Apr. 18, 1996 by William C. Young, Richard C. Darr and Dale H. Behm under the title Plastic Blow Molded Freestanding Container as a continuation of prior application Ser. No. 08/166,460, now abandoned, which was filed on Dec. 14, 1993 by William C. Young, Richard C. Darr and Dale H. Behm under the title Plastic Blow Molded Freestanding Container as a continuation of prior application Ser. No. 07/915,072, which issued on Dec. 22, 1994 as U.S. Pat. No. 5,287,978 and was filed on Jul. 16, 1992 by William C. Young, Richard C. Darr and Dale H. Behm under the title Plastic Blow Molded Freestanding Container as a continuation-in-part of prior application Ser. No. 07/771,636, which issued on Aug. 18, 1992 as U.S. Pat. No. 5,139,162 and which was filed on Oct. 4, 1991 by William C. Young and Richard C. Darr under the title Plastic Blow Molded Freestanding Container as a continuation of prior application Ser. No. 07/614,220 filed on Nov. 15, 1990 by William C. Young and Richard C. Darr under the title Plastic Blow Molded Freestanding Container and which issued on Nov. 12, 1991 as U.S. Pat. No. 5,064,080.

BACKGROUND OF THE INVENTION

1. Field of the Invention

This invention relates to a plastic blow molded container having a freestanding base structure for supporting the container while being capable of withstanding internal pressure.

2. Background Art

Conventional plastic blow molded containers for holding carbonated beverages that pressurize the container for the most part in the past have been manufactured as base cup containers wherein the lower extremity of the blow molded container has a hemispherical shape that is received within an injection molded plastic base cup which supports the container during use. Such a base cup permits the hemispherical shape to be utilized to provide the requisite strength for withstanding the internal pressure while still providing a flat surface on which the container can be supported in an upright position. While such containers function satisfactorily, there is a cost involved in both manufacturing and assembling the base cup to the blow molded container and such cost must necessarily be included in the price to the consumer.

Blow molded containers capable of withstanding pressure have also been manufactured with freestanding base structures that are unitary with the container body such as disclosed by U.S. Pat. No. 3,598,270 Adomaitis; U.S. Pat. No. 3,727,783 Carmichael; U.S. Pat. No. 3,759,410 Uhilig; U.S. Pat. No. 3,871,541 Adomaitis; and U.S. Pat. No. 3,935,955 Das; and by European Patent Application Publication Number 0 225 155. These patents disclose relatively early attempts to design a freestanding blow molded container capable of withstanding internal pressure by the provision of circumferentially spaced legs having lower feet on which the container is supported.

More recent plastic blow molded containers having freestanding base structures are disclosed by German Offenlegungsschrift 29 20 122 and Japanese patent document No. 1-99949 Sakano dated Apr. 18, 1989; and by U.S. Pat. No. 4,249,667 Pocock et al; U.S. Pat. No. 4,267,144 Collette et al; U.S. Pat. No. 4,276,987 Michel; U.S. Pat. No. 4,294,366 Chang; U.S. Pat. No. 4,318,489 Snyder et al; U.S. Pat. No. 4,335,821 Collette et al; U.S. Pat. No. 4,368,825 Motill; U.S. Pat. No. 4,785,949 Krishnakumar et al; U.S. Pat. No. 4,785,950 Miller et al; U.S. Pat. No. 4,850,493 Howard, Jr.; U.S. Pat. No. 4,850,494 Howard, Jr.; U.S. Pat. No. 4,867,323 Powers; and U.S. Pat. No. 4,910,054 Collette et al; U.S. Pat. No. 4,978,015 Walker; U.S. Pat. No. 4,598,831 Nakamura et al; U.S. Pat. No. 5,024,340 Alberghim et al; U.S. Pat. No. 5,064,080 Young et al; U.S. Pat. No. 5,072,841 Okhai; U.S. Pat. No. 5,133,468 Brunson et al; and U.S. Pat. No. 5,139,162 Young et al.

Also, U.S. Pat. No. 4,785,949 Krishnakumar et al and Japanese patent document No. 4-44943 Takakusaki disclose plastic blow molded containers having freestanding base structures including feet that is separated by curved ribs that taper from wider outer upper ends to narrower inner lower ends.

Certain of the containers disclosed by the above patents have flat feet on which the freestanding base structure is supported. However, some of the structures involved deflect under the pressure such that it is necessary to incline the lower feet upwardly in an inward direction as disclosed by U.S. Pat. No. 4,865,206 Behm et al so that the feet deflect downwardly to a coplanar relationship with each other upon being subjected to the internal pressure when the container is filled.

Also, United Kingdom patent application GB2189214A discloses a plastic blow molded container having a unitary base structure with a recess defined by a peripheral wall and a convex bottom wall. This recess is disclosed as functioning to centralize the preform used to blow mold the container and to also prevent the lower gate area through which the preform is injection molded from becoming the lowest portion of the container in a manner that could adversely affect stability.

SUMMARY OF THE INVENTION

An object of the present invention is to provide an improved plastic blow molded container having a freestanding base structure that provides good stability to the container even when subjected to internal pressure.

In carrying out the above object, the plastic blow molded container incorporating the invention has a central axis A and includes a body portion that extends vertically about the central axis A and has a lower extremity of a round shape with a diameter D, an upper end closure unitary with an upper extremity of the body portion and including a dispensing spout, and a freestanding base structure unitary with the body portion to close its lower extremity. The freestanding base structure includes a plurality of downwardly projecting hollow legs spaced circumferentially from each other with respect to the body portion. Each leg has a lower flat foot coplanar with the feet of the other legs to cooperate therewith in supporting the container in an upright position. Each leg also has an outer wall that extends from the outer extremity of the flat foot thereof to the body portion. The outer wall of each leg has a curved shape including an upper end that is tangent with the adjacent portion of the lower extremity of the body portion. The lower flat fee of the legs have an outer diameter $D_f$. The flat foot and the outer wall of each leg have a curved junction of a radius $R_j$. The radius $R_j$ is less than 0.05 of the diameter D. Each leg also has an inner connecting portion that is inclined and extends upwardly and inwardly from the inner extremity of its flat foot, and each leg also has a pair of side walls that cooperate with the flat foot, the outer wall and the inner connecting portion to close the leg. The freestanding base structure also includes a plurality of curved ribs spaced circumferentially from each other between the downwardly projecting legs and connecting the adjacent side walls of the legs. Each rib has an outer upper end that extends upwardly for connection to the body portion of the container. Each rib also has an inner lower end located between the inner connecting portions of the legs on opposite sides thereof and extending downwardly and inwardly toward the central axis A of the container. Each rib also has a curved intermediate portion that extends between the outer upper and inner lower ends thereof with an outwardly convex shape and each rib has a radius of curvature $R_r$ greater than about 0.6 of the diameter D of the lower extremity of the body portion and with a center of curvature on the opposite side of the central axis A from the rib.

The freestanding base structure also includes a generally round hub that is located along the central axis A with the legs and curved ribs extending radially from the hub. The hub has a periphery with a diameter $D_h$ in the range of about 0.15 to 0.25 of the diameter D of the lower extremity of the body portion. The periphery of the hub is spaced above the plane of the flat feet of the legs by a height $H_p$, and the ratio of the diameter $D_f$ over the height $H_p$ is in the range of about 25 to 90. The hub has connections to the upwardly extending inner connecting portions of the legs and the hub also having connections to the downwardly extending inner lower ends of the curved ribs.

In one embodiment, the hub of the base structure has an upwardly extending shape including a periphery connected to the upwardly extending inner connecting portions of the legs and to the downwardly extending inner lower ends of the curved ribs.

In another embodiment, the hub has a generally flat shape that extends horizontally and has a periphery connected to the upwardly extending inner connecting portions of the legs and to the downwardly extending inner lower ends of the curved ribs.

In a further embodiment, the hub has a downwardly extending shape including a periphery connected to the upwardly extending inner connecting portions of the legs and to the downwardly extending inner lower ends of the curved ribs.

The body portion of the container has a nominal wall thickness t, and the planar inner extremities of the flat feet, the inner connecting portions of the legs, the inner lower ends of the curved ribs, and the hub each have a wall thickness t' that is at least 1.7 times the nominal wall thickness t of the body portion. The lower flat foot of each leg has a truncated wedge shape, and each curved rib has a generally flat cross section between its ends.

The plastic blow molded container includes an odd number of legs and ribs, specifically five legs and five ribs, with each leg located in a diametrical opposite relationship to an associated rib.

The objects, features and advantages of the present invention are readily apparent from the following detailed description of the best modes for carrying out the invention when taken in connection with the accompanying drawings.

DETAILED DESCRIPTION OF THE PREFERRED EMBODIMENTS

Figure 1:
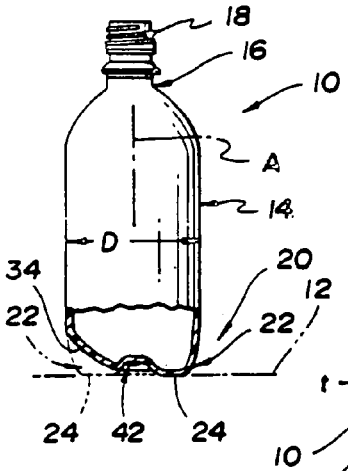
FIG. 1 is a side elevational view taken partially in section through one embodiment of a plastic blow molded container which includes a freestanding base structure constructed in accordance with the present invention.

With reference to FIG. 1 of the drawings, a plastic blow molded container constructed in accordance with the present invention is generally indicated by 10 and has a central axis A that extends vertically with the container supported on a horizontal surface 12 as shown. The plastic blow molded container 10 includes a cylindrical body portion 14 that extends vertically about the central axis A with a diameter D. An upper end closure 16 of the container is unitary with the upper extremity of the cylindrical body portion 14 and includes a dispensing spout which is illustrated as having a thread 18 for securing an unshown cap-type closure. The container also includes a freestanding base structure 20 constructed according to the present invention and unitary with the cylindrical body portion 14 to close its lower extremity. This freestanding base structure 20 as is more fully hereinafter described has the capability to provide good stability against tipping, which is especially desirable when the container is empty and being conveyed upright after manufacturing thereof and during movement through a filling line, and the freestanding base structure is also capable of withstanding internal pressure such as when the container is filled with carbonated beverage as well as resisting stress cracking.

Figure 2:
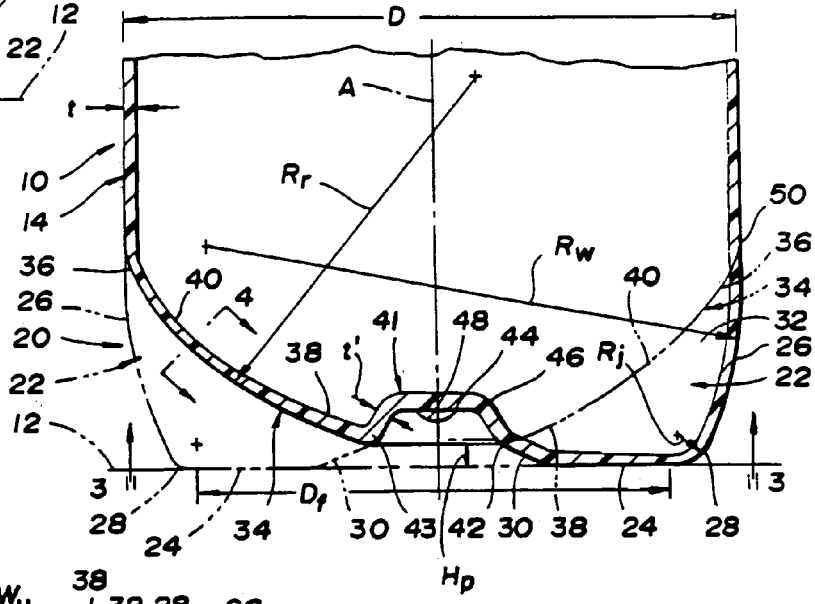
FIG. 2 is an enlarged view of a portion of FIG. 1 and further illustrates the construction of the freestanding base structure which has a central round hub that is illustrated as having an upwardly extending construction.
Figure 3:
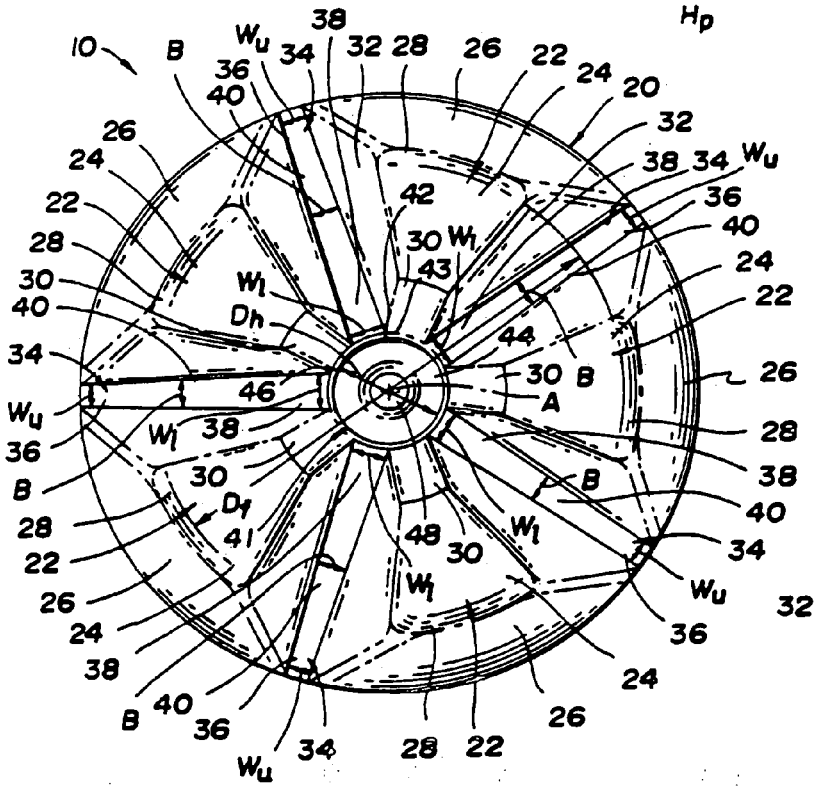
FIG. 3 is a bottom plan view of the container taken along the direction of line 3—3 in FIG. 2 to further illustrate the construction of the freestanding base structure.

With combined reference to FIGS. 1 through 3, the freestanding base structure 20 includes a plurality of downwardly projecting hollow legs 22 spaced circumferentially from each other with respect to the body portion. Each leg 22 has a lower flat foot 24 coplanar with the feet of the other legs to cooperate therewith in supporting the container in an upright position such as shown in FIG. 1. The lower flat feet 24 have an outer diameter $D_f$ that preferably is at least 0.75 of the diameter D of the cylindrical body portion to provide good stability of the container against tipping. Each leg 22 also has an outer wall 26 that extends from the outer extremity of the flat foot 24 thereof to the cylindrical body portion 14. The flat foot 24 and the outer wall 26 of each leg 22 have a curved junction 28 best shown in FIG. 2. This junction 28 has a radius of curvature $R_j$ at the outer surface of the container which preferably is less than 0.05 of the diameter D of the cylindrical body portion. Each leg 22 also has an inner connecting portion 30 that is inclined and extends upwardly and inwardly from the inner extremity of its flat foot 24. As best shown in FIGS. 2 and 3, each leg 22 also has a pair of side walls 32 that cooperate with the lower foot 24, the outer wall 26 and the inner planar connecting portion 30 to close the leg.

Figure 4:
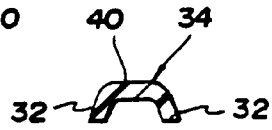
FIG. 4 is a sectional view taken along the direction of line 4—4 in FIG. 2 to illustrate the construction of ribs that are located between legs of the freestanding base structure.

As best illustrated in FIGS. 2 through 4, the freestanding base structure 20 also includes a plurality of curved ribs 34 spaced circumferentially from each other between the downwardly projecting legs 22 and connecting the adjacent side walls 32 of the legs. Each rib 34 as shown best in FIG. 2 has an outer upper end 36 that has a circumferential width $W_u$ (FIG. 3) and extends upwardly for connection to the cylindrical body portion 14 of the container as shown in FIG. 2. Each rib 34 also has an inner lower end 38 located between the inner connecting portions 30 of the legs 22 on opposite sides thereof as shown in FIG. 3 and extending downwardly and inwardly toward the central axis A of the container. The inner lower end 38 of each rib 34 has a circumferential width $W_l$ that as shown in FIG. 3 is larger than the circumferential width $W_u$ of the outer upper end 36 of the rib. As best shown in FIG. 2, each rib 34 also has a curved intermediate portion 40 that extends between the outer upper and inner lower ends 36 and 38 thereof with an outwardly convex shape. Providing the inner lower end 38 of each rib with a greater circumferential width $W_l$ than the circumferential width $W_u$ of the outer upper end 36 enhances the ability of the container to resist stress cracking as is hereinafter more fully described.

As best illustrated in FIGS. 2 and 3, the freestanding base structure 20 of the container also includes a generally round hub 41 located along the central axis A with the legs 22 and curved ribs 34 extending radially therefrom in a circumferentially alternating relationship to each other. This hub 41 has a diameter $D_h$ in the range of about 0.15 to 0.25 of the diameter D of the cylindrical body portion. Hub 41 includes a periphery having connections 42 to the upwardly extending planar inner connecting portions 30 of the legs, and the hub periphery also has connections 43 to the downwardly extending inner lower ends 38 of the curved ribs.

In the embodiment of the container shown in FIGS. 2 and 3, the hub 41 of the freestanding base structure has an upwardly extending shape whose periphery is connected to the upwardly extending planar inner connecting portions 30 of the legs and to the downwardly extending inner lower ends 38 of the curved ribs as described above. This upwardly extending hub 41 includes a round upper wall 44 and an annular wall 46 having an upper end connected to the upper wall thereof and extending downwardly therefrom with an inclination of at least 45° with respect to the flat feet 24 of the legs 22. Annular wall 46 of the hub 41 also has a lower end that defines a periphery of the hub and is connected to the inner connecting portions 30 of the feet 22 and to the inner lower ends 38 of the curved ribs 34. The upper wall 44 of the hub 41 is spaced above the plane of the flat feet 24 of the legs 22 by a greater height than the hub periphery at the lower end of annular wall 46. This freestanding base construction ensures that the preform from which the container is made can be expanded to define the junctions 28 between the outer extremities of the feet 24 and the outer walls 26 with a sufficiently thick wall thickness so as to have the requisite strength. Furthermore, the hub periphery at the lower end of the annular wall 46 of the hub 41 is spaced above the plane of the flat feet 24 by a height. $H_p$ sufficient to maintain the center of the container spaced upwardly from the surface 12 so that the sprue nub 48, which is used in the injection molding of the preform utilized to blow mold the container, is spaced above the support surface 12 such that the feet 24 are maintained in their coplanar relationship in surface-to-surface engagement with the support surface.

As illustrated in FIG. 3, the curved intermediate portion 40 of each rib 34 has a circumferential width that tapers from the inner lower end 38 thereof to the outer upper end 36 thereof with an included angle B in the range of about 1° to 8°. Most preferably, this included angle B defined by the curved intermediate portion 40 of each rib is about 2°. Such a taper provides an inner lower end 38 of the rib with the circumferential width $W_l$ that is sufficiently large to carry the stresses involved at this location which is relatively unoriented during the blow molding process as compared to the outer portions of the container. In other words, the inner hub area which has material that is not as strong due to the lack of molecular orientation during the blow molding process has a greater cross sectional area to carry the stress and thereby prevent stress cracking adjacent the hub.

With reference to FIG. 2, the periphery of the hub 41 as previously mentioned is spaced above the plane of the flat feet 24 of the legs 22 by the height $H_p$, and the ratio of the diameter $D_f$ over the height $H_p$ is in the range of about 25 to 90. Such a ratio provides a construction with sufficient strength to maintain the hub 41 spaced upwardly from the surface 12 on which the base structure 20 of the container 10 is supported.

In the most preferred construction, each rib 34 has its curved intermediate portion 40 provided with the included angle B of about 1° to 8° as well as having the ratio of the container diameter $D_f$ over the height $H_p$ of the hub in the range of about 25 to 90.

Figure 5:
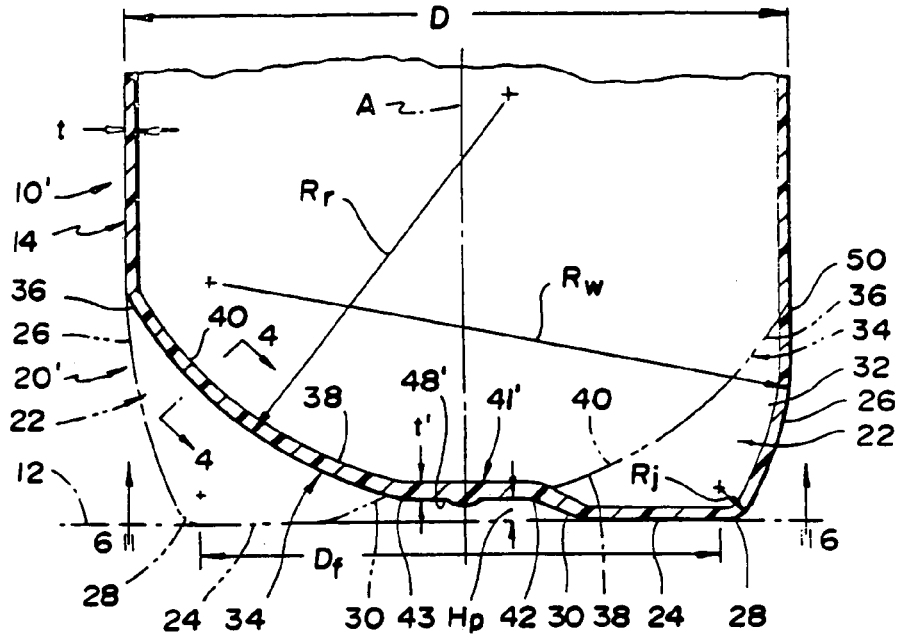
FIG. 5 is a sectional view similar to FIG. 2 but illustrating another embodiment of the blow molded container wherein the central round hub of the freestanding base structure has a generally flat shape that extends horizontally.
Figure 6:
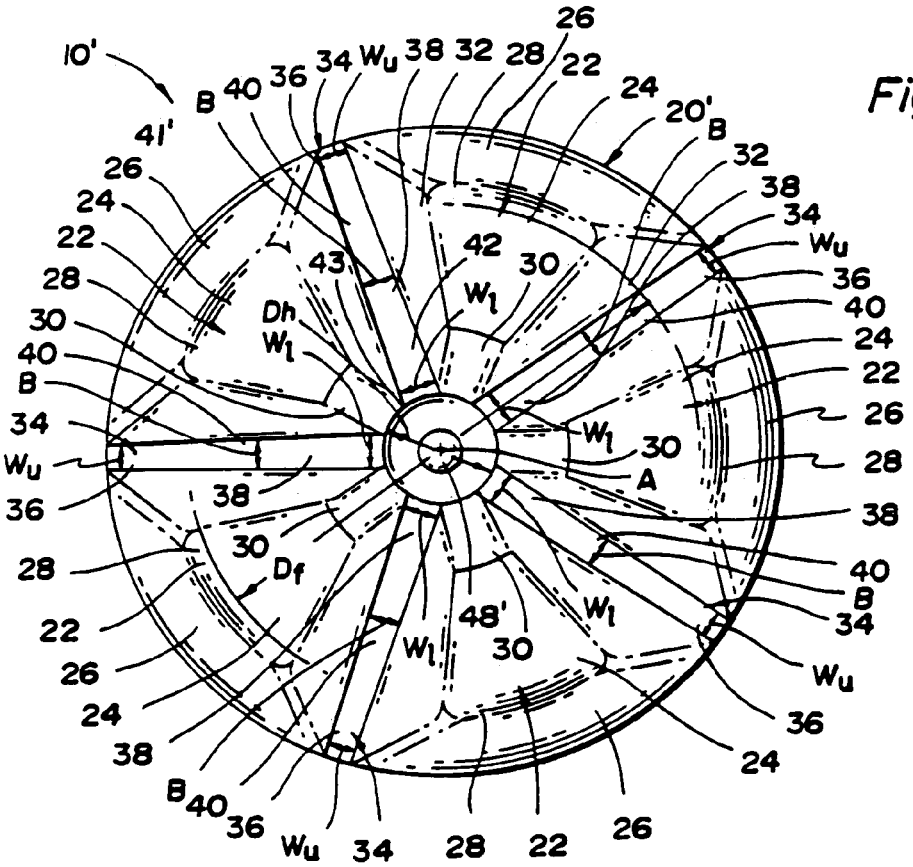
FIG. 6 is a bottom plan view of the container taken along the direction of line 6—6 in FIG. 5.

With reference to FIGS. 5 and 6, another embodiment of the container 10' has much of the same construction as the previously described embodiment except as will be noted and thus has like reference numerals identifying like components thereof such that the previous description is applicable and need not be repeated. However the hub 41' of the freestanding base structure 20' of this embodiment has a generally flat shape that extends horizontally as opposed to an upwardly extending shape as with the previously described embodiment. This horizontally extending flat hub 41' has a periphery connected by the connections 42 to the upwardly extending planar inner connecting portions 30 of the legs and by the connections 43 to the downwardly extending inner lower ends 38 of the curved ribs 34. These curved ribs 34 like the previously described embodiment have the circumferential width $W_l$ of the inner lower end 38 larger than the circumferential width $W_u$ of the outer upper end 36, and preferably the intermediate portion 40 of each rib has a tapering shape between these ends with angle B in the range of about 1° to 8° and most preferably about 2°. Furthermore, the flat hub 41' has its periphery spaced above the plane of the lower feet 24 by a height $H_p$ with the ratio of $D_f$ over $H_p$ being in the range of about 25 to 90 in the same manner as the previously described embodiment. This construction prevents injection molding sprue nub 48' from adversely affecting stability of the container by maintaining it above the support surface 12. Otherwise, this embodiment of the container 10' shown in FIGS. 5 and 6 is the same as the previously described embodiment of FIGS. 1 through 4.

Figure 7:
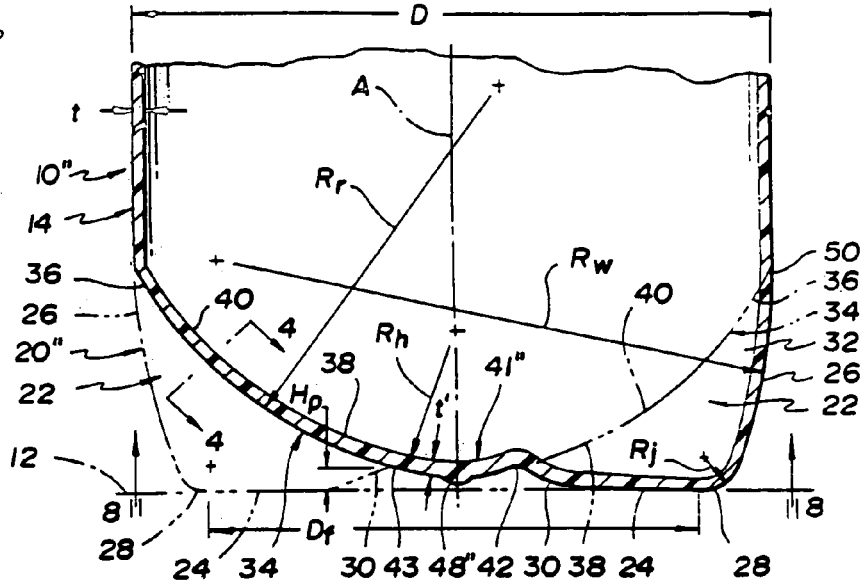
FIG. 7 is a sectional view taken in the same direction as FIGS. 2 and 5 but illustrating a further embodiment wherein the central round hub of the freestanding base structure has a downwardly extending construction.
Figure 8:
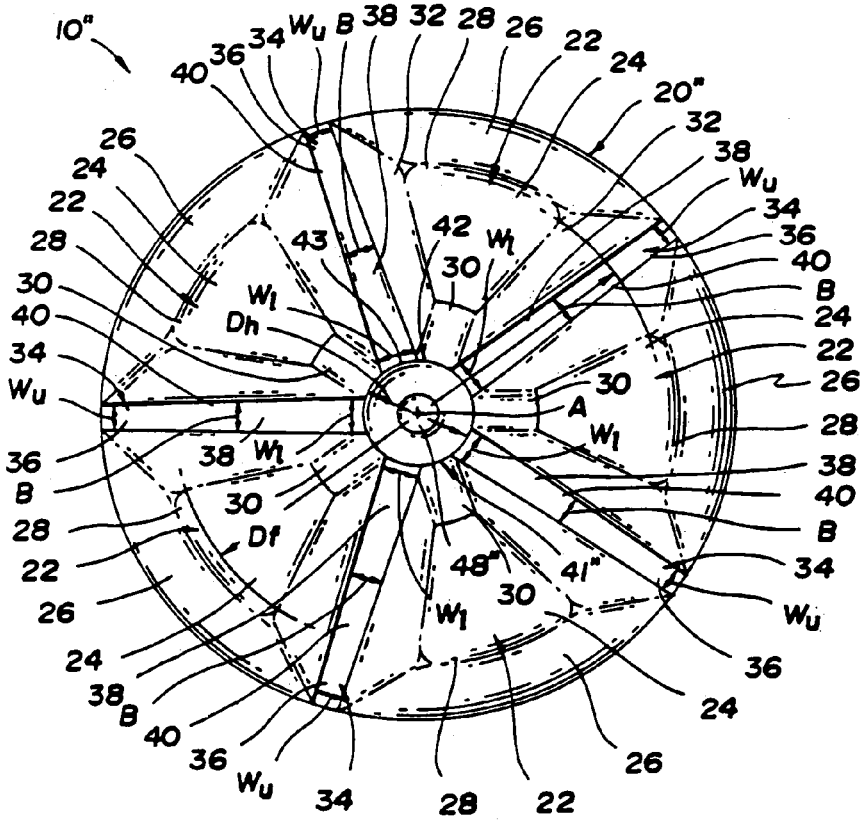
FIG. 8 is a bottom plan view taken along the direction of line 8—8 of FIG. 7.

With reference to FIGS. 7 and 8, a further embodiment of the container 10" also has generally the same construction as the embodiment of FIGS. 1 through 4 except as will be noted such that like reference numerals are applied to like components thereof and much of the previous description is applicable and thus will not be repeated. The plastic blow molded container 10" illustrated in FIG. 7 and 8 has its generally round hub 41" located along the central axis A provided with a downwardly extending shape whose periphery is connected by the connections 42 to the upwardly extending planar inner connecting portions 30 of the legs and by the connections 43 to the downwardly extending inner ends 38 of the curved ribs. More specifically as best illustrated in FIG. 7, the central hub 41" preferably has a curved shape and most preferably has a radius of curvature $R_h$ that is less than one-half the radius of curvature $R_r$ of the curved intermediate portion 40 of each rib 34. These curved ribs 34 like the previously described embodiments have the circumferential width $W_l$ of the inner lower end 38 larger than the circumferential width $W_u$ of the outer upper end 36, and preferably the intermediate portion 40 of each rib has a tapering shape between these ends with angle B in the range of about 1° to 8° and most preferably about 2°. Furthermore, the downwardly extending hub 41" has its periphery spaced above the plane of the flat feet 24 by a height $H_p$ with the ratio of $D_f$ over $H_p$ being in the range of about 25 to 90 in the same manner as the previously described embodiments. This construction spaces the injection molding sprue nub 48" above the support surface 12 so as not to adversely affect stability of the container. In the specific construction disclosed, the radius of curvature $R_h$ of the downwardly extending hub 41" is about one-third the radius of curvature $R_r$ of the intermediate portion 40 of the rib 34 which, as is hereinafter described, is greater than about 0.6 of the diameter D of the cylindrical body portion 14.

In each of the embodiments described above as illustrated in FIGS. 2, 5 and 7, the cylindrical body portion 14 of the container 10, 10' and 10" has a nominal wall thickness t which is normally in the range of about 0.009 to 0.011 of an inch. The construction of the freestanding base structure 20 has the inner extremities of the flat feet 24, the inner connecting portions 30 of the legs, the inner lower ends 38 of the curved ribs 34 and the associated hub 41, 41' and 41" each provided with a wall thickness t' that is at least 1.7 times the nominal wall thickness t of the cylindrical body portion and preferably about 2 times the nominal wall thickness t.

With reference to FIGS. 3, 6 and 8, each container embodiment has its freestanding base structure constructed such that the lower flat foot 24 of each leg 22 has a truncated wedge shape whose truncated inner end terminates at the associated planar inner connecting portion 30 of the foot and whose curved outer end is defined at the junction 28 with the associated outer wall 26.

As illustrated in FIG. 4, each container embodiment has each rib 34 between the adjacent pair of leg side walls 32 provided with a flat cross section along the intermediate rib portion 40 between its ends. This flat cross section of each rib 34 thus extends from its narrower outer upper end 36 along the tapering intermediate rib portion 40 to its wider inner lower end 38 at the junction with the lower end of the annular wall 46 of the hub 42. The flat rib cross-section shown in FIG. 4 is illustrative of the construction of each container embodiment 10, 10' and 10".

As illustrated in FIGS. 2, 5 and. 7, the outer wall 26 of each leg 22 has a curved shape including an upper end 50 that is tangent with the adjacent portion of the lower extremity of the cylindrical body portion 14 of the container. The curvature of this outer wall 26 as well as the curvature of each rib 34 constitute features that enable the freestanding base structure to have good stability as well as the strength to withstand internal pressure as part of the construction previously described. More specifically, the outer wall 26 of each foot has a radius of curvature $R_w$ greater than 0.75 of the diameter D of the cylindrical body portion so that the outer diameter $D_f$ of the flat feet 24 can be as large as possible when the junction 28 is constructed as described previously with a radius of curvature $R_j$ of less than 0.05 of the diameter D of the cylindrical body portion. Furthermore, each rib 34 has a radius of curvature $R_r$ greater than about 0.6 of the diameter D of the cylindrical body portion and with a center of curvature on the opposite side of the central axis A from the rib.

As shown in FIGS. 3, 6 and 8, the freestanding base 20 of the container 10 is disclosed as including an odd number of legs 22 and ribs 34 with each leg 22 located in a diametrically opposite relationship to the associated rib .34 about the central axis A. More specifically, the containers 10, 10' and 10" are each illustrated as including five legs 22 and five ribs. 34 which is the preferred number so as to provide best stability against tipping such as when supported on refrigerator wire shelves or other discontinuous supports.

The blow molded containers 10, 10' and 10" shown are manufactured from polyethylene terephthalate by injection stretch blow molding. This produces a biaxially oriented container wall with increased strength and the capability of withstanding internal pressure when made with the freestanding base structure as described above.

While the best modes for practicing the invention have been described in detail, those familiar with the art to which this invention relates will recognize various alternative designs and embodiments for practicing the invention as defined by the following claims.

What is claimed is:

1. A plastic blow molded container having a central axis A and including a body portion that extends vertically about the central axis A and has a lower extremity of a round shape with a diameter D, an upper end closure unitary with an upper extremity of the body portion and including a dispensing spout, and a freestanding base structure unitary with the body portion to close the lower extremity thereof, said freestanding base structure comprising:

a plurality of downwardly projecting hollow legs spaced circumferentially from each other with respect to the body portion; each leg having a lower flat foot coplanar with the feet of the other legs to cooperate therewith in supporting the container in an upright position; each leg also having an outer wall that extends from the outer extremity of the flat foot thereof to the body portion; the outer wall of each leg having a curved shape including an upper end that is tangent with the adjacent portion of the lower extremity of the body portion; the lower flat feet of the legs having an outer diameter $D_f$; the flat foot and the outer wall of each leg having a curved junction of a radius $R_j$; the radius $R_j$ being less than 0.05 of the diameter D; each leg also having an inner connecting portion that is inclined and extends upwardly and inwardly from the inner extremity of the flat foot thereof; and each leg also having a pair of side walls that cooperate with the flat foot, the outer wall and the inner connecting portion to close the leg;

a plurality of curved ribs spaced circumferentially from each other between the downwardly projecting legs and connecting the adjacent side walls of the legs; each rib having an outer upper end that extends upwardly for connection to the body portion of the container; each rib also having an inner lower end located between the inner connecting portions of the legs on opposite sides thereof and extending downwardly and inwardly toward the central axis A of the container; each rib also having a curved intermediate portion that extends between the outer upper and inner lower ends thereof with an outwardly convex shape and each rib having a radius of curvature $R_r$ greater than about 0.6 of the diameter D of the lower extremity of the body portion and with a center of curvature on the opposite side of the central axis A from the rib; and a generally round hub that is located along the central axis A with the legs and curved ribs extending radially therefrom; said hub having a periphery with a diameter $D_h$ in the range of about 0.15 to 0.25 of the diameter D of the lower extremity of the body portion; the periphery of the hub being spaced above the plane of the flat feet of the legs by a height $H_p$, the ratio of the diameter $D_f$ over the height $H_p$ being in the range of about 25 to 90; and the hub having connections to the upwardly extending inner connecting portions of the legs and the hub also having connections to the downwardly extending inner lower ends of the curved ribs.

2. A plastic blow molded container as in claim 1 wherein the periphery of the hub has an upwardly extending shape connected to the upwardly extending inner connecting portions of the legs and to the downwardly extending inner lower ends of the curved ribs.

3. A plastic blow molded container as in claim 1 wherein the hub has a generally flat shape that extends horizontally and the periphery of the hub being connected to the upwardly extending inner connecting portions of the legs and to the downwardly extending inner lower ends of the curved ribs.

4. A plastic blow molded container as in claim 1 wherein the hub has a downwardly extending shape and the periphery of the hub being connected to the upwardly extending inner connecting portions of the legs and to the downwardly extending inner lower ends of the curved ribs.

5. A plastic blow molded container as in claim 1 wherein the body portion has a nominal wall thickness t and wherein the planar inner extremities of the flat feet, the inner connecting portions of the legs, the inner lower ends of the curved ribs, and the hub each has a wall thickness t' that is at least 1.7 times the nominal wall thickness t of the body portion.

6. A plastic blow molded container as in claim 1 wherein the lower flat foot of each leg has a truncated wedge shape.

7. A plastic blow molded container as in claim 1 wherein each curved rib has a generally flat cross section between its ends.

8. A plastic blow molded container as in claim 1 which includes an odd number of legs and ribs with each leg located in a diametrical opposite relationship to an associated rib.

9. A plastic blow molded container as in claim 8 which includes five legs and five ribs.

* * * * *